US010345735B2

(12) United States Patent
Nojiri

(10) Patent No.: US 10,345,735 B2
(45) Date of Patent: Jul. 9, 2019

(54) DEVELOPING ROLLER

(71) Applicant: SUMITOMO RUBBER INDUSTRIES, LTD., Kobe-shi, Hyogo (JP)

(72) Inventor: Kazuki Nojiri, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/994,210

(22) Filed: May 31, 2018

(65) Prior Publication Data

US 2019/0004449 A1 Jan. 3, 2019

(30) Foreign Application Priority Data

Jun. 30, 2017 (JP) ..... 2017-128967

(51) Int. Cl.
*G03G 15/08* (2006.01)

(52) U.S. Cl.
CPC . *G03G 15/0818* (2013.01); *G03G 2215/0634* (2013.01)

(58) Field of Classification Search
None
See application file for complete search history.

(56) References Cited

U.S. PATENT DOCUMENTS

| | | | | |
|---|---|---|---|---|
| 5,993,366 | A * | 11/1999 | Kaji | G03G 15/0818 428/36.9 |
| 6,703,094 | B2 * | 3/2004 | Kakii | G03G 15/0233 361/225 |
| 7,869,749 | B2 * | 1/2011 | Mizumoto | G03G 15/0818 399/279 |
| 2005/0078986 | A1 * | 4/2005 | Nakamura | G03G 15/0818 399/286 |
| 2010/0080611 | A1 * | 4/2010 | Kurachi | G03G 15/0818 399/111 |

FOREIGN PATENT DOCUMENTS

| | | | |
|---|---|---|---|
| JP | 10-293453 | A | 11/1998 |
| JP | 2005-134503 | A | 5/2005 |
| JP | 2008-164814 | A | 7/2008 |
| JP | 2009-244667 | A | 10/2009 |
| JP | 2014-170158 | A | 9/2014 |

* cited by examiner

*Primary Examiner* — Victor Verbitsky
(74) *Attorney, Agent, or Firm* — Birch, Stewart, Kolasch & Birch, LLP

(57) ABSTRACT

An inventive developing roller (1) includes a roller body (5) which includes an inner layer (2) having a porous structure and an outer layer (4) of a seamless nonporous tube. The porous structure of the inner layer (2) is formed from a semiconductive rubber composition containing ethylene propylene rubber, paraffin oil and carbon black having a DBP oil absorption amount of not less than 400 $cm^3$/100 g. The nonporous tube for the outer layer (4) contains a polyurethane thermoplastic elastomer having a type-A durometer hardness of not higher than 93, carbon black and crosslinked PMMA particles having a median particle diameter of 5 μm to 20 μm.

5 Claims, 1 Drawing Sheet

DEVELOPING ROLLER

TECHNICAL FIELD

The present invention relates to a developing roller to be used in an electrophotographic image forming apparatus.

BACKGROUND ART

In an electrophotographic image forming apparatus such as a laser printer, an electrostatic copying machine, a plain paper facsimile machine or a printer-copier-facsimile multifunction machine, a nonmagnetic single-component developing system is mainly employed as a developing system.

In the nonmagnetic single-component developing system, toner is passed through between a developing roller and a toner amount regulating blade to be triboelectrically charged and carried on a surface of the developing roller, whereby a toner layer is formed on the surface. Then, the toner layer thus formed is brought into direct contact with a surface of a photoreceptor body formed with an electrostatic latent image, whereby the toner is selectively transferred from the toner layer to the electrostatic latent image to develop the electrostatic latent image into a toner image. Alternatively, the toner layer is brought into noncontact adjacent relation to the surface of the photoreceptor body, whereby the toner is selectively transferred (or allowed to selectively jump) from the toner layer to the electrostatic latent image to develop the electrostatic latent image into a toner image.

The developing roller typically includes a roller body of a nonporous single-layer structure formed by preparing a semiconductive rubber composition containing rubber, a crosslinking component for crosslinking the rubber and an electron conductive agent and/or an ion conductive agent, forming the semiconductive rubber composition into a tubular body, and crosslinking the rubber of the rubber composition of the tubular body.

However, the roller body of the conventional developing roller described above has a relatively high hardness, so that the toner is liable to be frictionally broken to be thereby deteriorated. This may result in formation of coarse images. Further, fine particles of an external additive are liable to be frictionally buried in toner particles to thereby impair the fluidity of the toner. This may result in formation of uneven-density images or in formation of streaked uneven-density images due to a so-called slip-stick phenomenon of the toner amount regulating blade. Therefore, the roller body is required to be highly flexible for prevention of these imaging defects.

In Patent Document 1, it is contemplated to use liquid silicone rubber as the rubber to improve the flexibility of the roller body. As described in Patent Document 1, however, the liquid silicone rubber should be cast-molded into a roller body shape with the use of a mold conformal to the outer shape of the roller body. This requires complicated operations, resulting in reduction in productivity.

As in the conventional case, it is also conceivable to prepare a soft rubber composition by blending a crosslinking component and oil as a softening agent with solid rubber which can be formed into a predetermined shape by an extrusion method or the like without the use of the mold, and form the soft rubber composition into a flexible roller body. However, the oil is liable to bleed on the outer peripheral surface of the roller body to result in contamination of the photoreceptor body and the like.

To cope with this, it is contemplated to prepare a rubber composition by blending the solid rubber, the crosslinking component and a foaming component for foaming the rubber, and produce a flexible roller body of a porous structure from the rubber composition through a forming step, a crosslinking step and a foaming step.

In some case, opposite end portions of the outer peripheral surface of the roller body are respectively sealed with seal members in order to prevent the toner carried on the outer peripheral surface of the roller body from leaking outside a developing unit incorporating the developing roller. The seal members are formed, for example, of felt or the like, and fixed to a housing of the developing unit and kept in sliding contact with the opposite end portions of the outer peripheral surface of the roller body of the developing roller during rotation of the developing roller.

However, the toner is liable to leak from the opposite end portions of the roller body sealed with the seal members when image formation is repeatedly performed. This is because the opposite end portions of the outer peripheral surface of the roller body are liable to be worn due to the sliding contact with the seal members and gaps are formed between the opposite end portions and the seal members.

Particularly, where the roller body has the porous structure to be imparted with higher flexibility, as described above, the roller body is more liable to be worn. Therefore, the leakage of the toner and the like may occur in a shorter period of time. To cope with this, it is contemplated to coat at least the seal member contact portions of the outer peripheral surface with coating films to reduce the friction occurring between the seal member contact portions and the seal members for suppression of the friction, while imparting the roller body per se with a porous structure having proper flexibility (see, for example, Patent Document 2 and the like).

The coating film is formed by preparing a liquid coating agent containing a binder resin such as a urethane resin, a phenol resin, a fluororesin or a silicone resin, applying the liquid coating agent onto the outer peripheral surface of the roller body by a spraying method, a dipping method or other applying method, drying the applied coating agent and, optionally, curing the urethane resin or the phenol resin. Alternatively, as disclosed in Patent Document 1, the surface roughness of the surface of the coating film, i.e., the surface roughness of the outer peripheral surface of the roller body, may be adjusted by blending roughness imparting particles such as urethane particles in the coating agent to control the amount of the toner carried on the outer peripheral surface and the toner charge amount.

The coating film of the urethane resin or the phenol resin is excellent in wear resistance, but is less slidable. This increases the rotating torque of the developing roller, making proper image formation difficult. On the other hand, the coating film of the fluororesin or the silicone resin is excellent in slidability, but is insufficient in wear resistance. Therefore, the coating film is liable to be worn out in a shorter period of time to lose its effect.

During the formation of the coating film, the coating film is liable to suffer from various inconveniences, i.e., contamination with foreign matter such as dust and uneven thickness. For preparation of the liquid coating agent, an organic solvent is required for dissolving the binder resin. The use of the organic solvent may exert a great load on the environment, and go against a recent trend toward reduction of VOC (volatile organic compounds). In addition, the binder resin is limited to those soluble in the organic solvent.

It is also contemplated to form a porous tubular body as an inner layer from a semiconductive rubber composition and cover the generally entire outer peripheral surface of the inner layer with an outer layer of a seamless nonporous tube formed from a semiconductive resin to produce a roller body (Patent Documents 3, 4 and the like).

The tube is formed, for example, by extruding the resin. A resin excellent in strength, wear resistance and the like can be selected for use as the resin for the tube without the need for consideration of the solubility in the organic solvent. Therefore, the outer layer of the nonporous tube has higher strength and excellent wear resistance and, unlike the coating film formed from the liquid coating agent, is prevented from losing its effect due to the wear-out in a short period of time.

CITATION LIST

Patent Document

[PATENT DOCUMENT 1] JP2008-164814A
[PATENT DOCUMENT 2] JP-HEI10(1998)-293453A
[PATENT DOCUMENT 3] JP2005-134503A
[PATENT DOCUMENT 4] JP2014-170158A

SUMMARY OF THE INVENTION

Problem to be Solved by the Invention

However, studies conducted by the inventor of the present invention revealed that the conventional developing roller including the roller body having the inner layer of the porous structure and the outer layer of the seamless nonporous tube as disclosed in Patent Documents 3 and 4 still requires improvement, because sufficient consideration is not given to the materials to be used for the respective layers in combination.

It is an object of the present invention to provide a developing roller which includes a roller body having an inner layer of a porous structure and an outer layer of a seamless nonporous tube and is improved in various characteristic properties.

Solution to Problem

According to the present invention, there is provided a developing roller including a roller body which has: a tubular inner layer formed from a semiconductive rubber composition containing ethylene propylene rubber, paraffin oil and carbon black having a DBP oil absorption amount of not less than 400 $cm^3$/100 g, and having a porous structure; and an outer layer of a seamless nonporous semiconductive tube provided on an outer periphery of the inner layer, the seamless nonporous semiconductive tube comprising a polyurethane thermoplastic elastomer having a type-A durometer hardness of not higher than 93 as measured at a measurement temperature of 23° C. in conformity with Japanese Industrial Standards JIS $K7311_{-1995}$, carbon black and particles of crosslinked polymethyl methacrylate having a median particle diameter of not less than 5 μm and not greater than 20 μm.

Effects of the Invention

According to the present invention, the developing roller which includes the porous inner layer and the outer layer of the seamless tube is improved in various characteristic properties.

EMBODIMENTS OF THE INVENTION

Figure 1A:
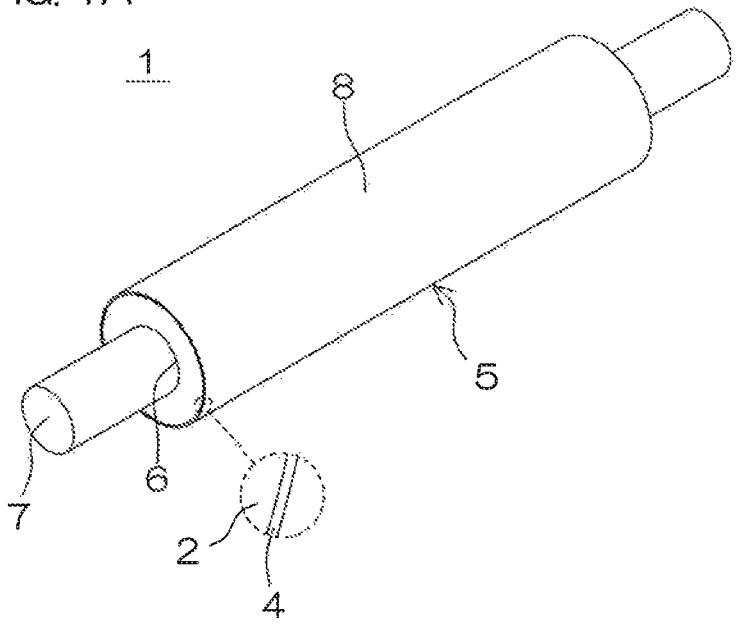
FIG. 1A is a perspective view showing an exemplary developing roller according to one embodiment of the present invention.
Figure 1B:
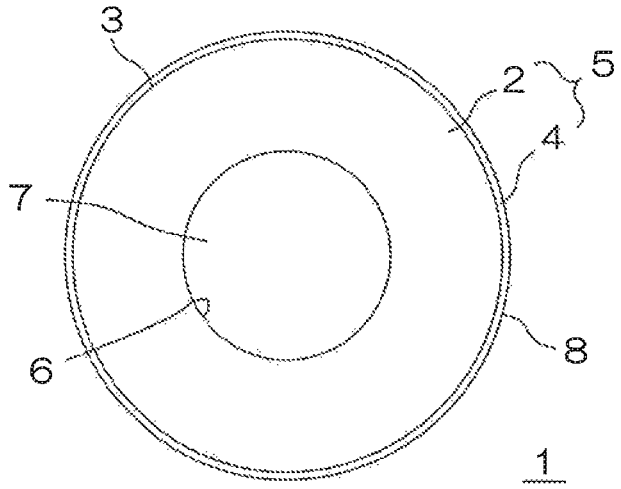
FIG. 1B is an end view of the developing roller according to the embodiment.

FIG. 1A is a perspective view showing an exemplary developing roller according to one embodiment of the present invention, and FIG. 1B is an end view of the developing roller according to the embodiment.

Referring to FIGS. 1A and 1B, the developing roller 1 according to this embodiment includes a roller body 5 of a double layer structure including a tubular inner layer 2 of a porous structure formed from a semiconductive rubber composition and an outer layer 4 of a seamless nonporous semiconductive tube provided on an outer peripheral surface 3 of the inner layer 2. A shaft 7 is inserted through and fixed to a center through-hole 6 of the inner layer 2.

The semiconductive rubber composition for the inner layer 2 contains ethylene propylene rubber, paraffin oil and carbon black.

For the semiconductive rubber composition, the ethylene propylene rubber, which is excellent in affinity for the paraffin oil and compatibility with the paraffin oil, is used in combination with the paraffin oil. Thus, the semiconductive rubber composition has a lower melt viscosity and, therefore, is easily foamable. Accordingly, the semiconductive rubber composition has an increased expansion ratio when being foamed and crosslinked, thereby improving the flexibility of the inner layer 2.

In addition, where the carbon black is electron-conductive, it is possible to impart the semiconductive rubber composition with proper semiconductivity, thereby reducing the roller resistance of the developing roller 1 to a range suitable for the developing roller 1. However, the carbon black should have a DBP oil absorption amount of not less than 400 $cm^3$/100 g.

Aggregates of the carbon black are combined with each other into agglomerates, thereby forming an electrically conductive circuit. The ratio of voids defined between the individual aggregates has positive correlation with the structure of the carbon black. Therefore, if the carbon black has a larger structure, the semiconductive rubber composition can be imparted with higher electrical conductivity by blending even a small amount of the carbon black. The structure of the carbon black is indirectly quantified based on the DBP oil absorption amount.

According to studies conducted by the inventor of the present invention, if the carbon black has a DBP oil absorption amount less than the aforementioned range and a smaller structure, it will be necessary to blend the carbon black in a greater proportion in order to impart the semiconductive rubber composition with the proper semiconductivity to reduce the roller resistance of the developing roller 1 to the proper range.

If the proportion of the carbon black is increased, however, the semiconductive rubber composition will have a correspondingly increased melt viscosity. In order to reduce the melt viscosity for easy foaming of the semiconductive rubber composition, therefore, it will be necessary to blend the paraffin oil in a greater proportion.

However, the paraffin oil has an insulative property, which is contradictory to the function of the carbon black in terms of the roller resistance of the developing roller 1. This makes it difficult to properly balance the proportions of the paraffin oil and the carbon black. In addition, the carbon black and the paraffin oil will be required in greater amounts, thereby increasing the production costs of the inner layer 2 formed from the semiconductive rubber composition and, hence, the production costs of the developing roller 1.

Where the carbon black has an improved structure with a DBP oil absorption amount of not less than 400 $cm^3$/100 g, in contrast, it is possible to impart the semiconductive rubber composition with the proper semiconductivity by blending a smaller proportion of the carbon black in the semiconductive rubber composition to reduce the roller resistance of the developing roller 1 to the proper range as can be understood from the electrically conductive circuit formation mechanism described above. In addition, only a small proportion of the paraffin oil is required for reducing the melt viscosity of the semiconductive rubber composition for the easy foaming of the semiconductive rubber composition. This makes it easier to properly balance the proportions of the carbon black and the paraffin oil, and suppresses the increase in the costs of the developing roller 1.

The tube for the outer layer 4 which is combined with the inner layer 2 to provide the roller body 5 of the developing roller 1 contains a polyurethane thermoplastic elastomer, carbon black and particles of crosslinked polymethyl methacrylate (hereinafter sometimes referred to simply as "crosslinked PMMA particles").

The tube for the outer layer 4 is formed in a seamless nonporous state from a polyurethane thermoplastic elastomer which is highly polar and has lower affinity for and lower compatibility with the ethylene propylene rubber and the paraffin oil. Thus, the outer layer 4 can function as a barrier layer with respect to the paraffin oil. This prevents the paraffin oil contained in the inner layer 2 from bleeding onto the surface of the outer layer 4, i.e., the outer peripheral surface 8 of the roller body 5, to suppress the contamination of the photoreceptor body and the like.

Even if other highly-polar thermoplastic elastomer such as a polyester or polyamide thermoplastic elastomer is used for the tube, the resulting outer layer can similarly function as the barrier layer. However, the polyurethane thermoplastic elastomer is more excellent in wear resistance than the other thermoplastic elastomer. Therefore, the outer layer 4 can be formed as having further higher strength and more excellent wear resistance by selectively using the polyurethane thermoplastic elastomer.

However, the polyurethane thermoplastic elastomer should have a type-A durometer hardness of not higher than 93 as measured at a measurement temperature of 23° C. If the carbon black and the crosslinked PMMA particles are blended with a polyurethane thermoplastic elastomer having a type-A durometer hardness higher than the aforementioned range, the tube is liable to become harder, so that the outer layer 4 has insufficient flexibility. Even if the tube is combined with the inner layer 2 of the porous structure described above, the roller body 5 is liable to have lower flexible.

Where the type-A durometer hardness of the polyurethane thermoplastic elastomer falls within the aforementioned range, in contrast, the tube is prevented from becoming harder even with the carbon black and the crosslinked PMMA particles blended in the rubber composition. Thus, the outer layer 4 is imparted with the proper flexibility. This further improves the flexibility of the roller body 5 with the outer layer 4 combined with the inner layer 2 of the porous structure.

Where electron-conductive carbon black is selectively used to impart the tube with semiconductivity, variations in the roller resistance of the developing roller 1 due to a difference in use environment, i.e., differences in temperature and humidity, are reduced to constantly stabilize the roller resistance as compared with a case in which an ion-conductive agent is used.

As described above, the tube is formed, for example, by the extrusion method. Therefore, a polyurethane thermoplastic elastomer excellent in strength, wear resistance and the like can be selected for use as the polyurethane thermoplastic elastomer for the tube without the need for consideration of the solubility thereof in an organic solvent. Thus, the outer layer 4 of the tube having the nonporous structure has higher strength and excellent wear resistance and, unlike the coating film formed from the liquid coating agent, is prevented from losing its effect due to the wear-out in a short period of time.

The crosslinked PMMA particles are excellent in heat resistance and pressure resistance. Unlike uncrosslinked polystyrene particles and uncrosslinked acryl resin particles, the crosslinked PMMA particles are free from easy melting, breakage or deformation even if being subjected to high-temperature heat and/or high pressure. That is, when an elastomer composition as a material for the tube is prepared by kneading the crosslinked PMMA particles with the polyurethane thermoplastic elastomer and the carbon black or when the elastomer composition is extruded into the tube, the crosslinked PMMA particles are maintained in the particulate form without the melting, the breakage and the deformation.

Therefore, the surface roughness of the surface of the outer layer 4 of the tube, i.e., the outer peripheral surface 8 of the roller body 5, can be adjusted by blending the crosslinked PMMA particles in the elastomer composition, making it possible to control the amount of the toner to be carried on the outer peripheral surface 8 and the toner charge amount.

However, the crosslinked PMMA particles should have a median particle diameter of not less than 5 μm and not greater than 20 μm.

If the median particle diameter of the crosslinked PMMA particles is less than the aforementioned range, the surface of the outer layer 4 of the tube, i.e., the outer peripheral surface 8 of the roller body 5, is liable to have insufficient surface roughness. As a result, the amount of the toner to be carried on the outer peripheral surface 8 is liable to be insufficient, resulting in formation of lower-density images or blurred images.

If the median particle diameter of the crosslinked PMMA particles is greater than the aforementioned range, on the other hand, the outer peripheral surface 8 of the roller body 5 is liable to have excessively great surface roughness. Therefore, an excessively great amount of the toner will be carried on the outer peripheral surface 8, so that the individual toner particles have a reduced chance of being rubbed with each other. This will result in insufficient toner charge amount and, hence, in a so-called fogging defect.

Where the median particle diameter of the crosslinked PMMA particles falls within the aforementioned range, in contrast, it is possible to adjust the surface roughness of the outer peripheral surface 8 of the roller body 5 within a range suitable for carrying the toner, thereby ensuring proper image formation without any of the aforementioned imaging defects.

<<Inner Layer 2>>

< Ethylene Propylene Rubber>

Examples of the ethylene propylene rubber include ethylene propylene rubber (EPM) which is a copolymer of ethylene and propylene, and ethylene propylene diene rubber (EPDM) which is a copolymer of ethylene, propylene and a diene. Particularly, the EPDM is preferred.

Usable as the EPDM are various copolymers prepared by copolymerizing ethylene, propylene and a diene. Examples of the diene include ethylidene norbornene (ENB) and dicyclopentadiene (DCPD).

Examples of the EPDM in which the diene is ENB include ESPRENE (registered trade name) EPDM 501A (non-oil-extension type having an ethylene content of 52% and a diene content of 4.0%) and 505A (non-oil-extension type having an ethylene content of 50% and a diene content of 9.5%) available from Sumitomo Chemical Co., Ltd., at least one of which may be used. Examples of the EPDM in which the diene is DCPD include ESPRENE EPDM 301A (non-oil-extension type having an ethylene content of 50% and a diene content of 5.0%), 301 (non-oil-extension type having an ethylene content of 62% and a diene content of 3.0%) and 305 (non-oil-extension type having an ethylene content of 60% and a diene content of 7.5%) available from Sumitomo Chemical Co., Ltd., which may be used alone or in combination.

The aforementioned EPDMs are non-oil-extension type EPDMs. In addition, oil-extension type EPDMs extended with an extension oil are also known. Of these oil-extension type EPDMs, an EPDM extended with paraffin oil may be used as the EPDM plus the paraffin oil in the present invention.

The aforementioned EPDMs may be used alone or in combination.

(Other Rubber)

For further improvement of the aforementioned effects of the combinational use of the ethylene propylene rubber, the paraffin oil and the carbon black having a DBP oil absorption amount of not less than 400 $cm^3$/100 g, the ethylene propylene rubber (which may include two or more types of ethylene propylene rubbers) is preferably used alone as a rubber component for the inner layer 2.

However, other rubber may be used in combination with the ethylene propylene rubber, as long as the aforementioned effects are not impaired. Examples of the other rubber include natural rubber, isoprene rubber, butadiene rubber, styrene butadiene rubber, acrylonitrile butadiene rubber and chloroprene rubber, which may be used alone or in combination. The proportion of the other rubber to be blended is preferably not greater than 20 parts by mass, particularly preferably not greater than 10 parts by mass, based on 100 parts by mass of the overall rubber component.

<Paraffin Oil>

Usable as the paraffin oil are various paraffin oils highly compatible with the ethylene propylene rubber.

Examples of the paraffin oil include DIANA (registered trade name) PROCESS OIL PW series available from Idemitsu kosan Co., Ltd., which may be used alone or in combination.

The proportion of the paraffin oil to be blended is preferably not less than 40 parts by mass and not greater than 100 parts by mass, particularly preferably not less than 60 parts by mass and not greater than 80 parts by mass, based on 100 parts by mass of the overall rubber component containing at least the ethylene propylene rubber.

If the proportion of the paraffin oil is less than the aforementioned range, it will be impossible to sufficiently provide the aforementioned effects of the blending of the paraffin oil for reducing the melt viscosity of the semiconductive rubber composition to improve the foamability and for increasing the expansion ratio to improve the flexibility of the inner layer 2 and, hence, the flexibility of the roller body 5. If the proportion of the paraffin oil is greater than the aforementioned range, on the other hand, an excess amount of the paraffin oil will bleed onto the outer peripheral surface 3 of the inner layer 2, i.e., in an interface between the inner layer 2 and the outer layer 4, to inhibit the electrical conduction between the outer layer 4 and the inner layer 2, thereby increasing the roller resistance of the developing roller 1. Further, the outer layer 4 is liable to be displaced with respect to the inner layer 2.

Where the proportion of the paraffin oil falls within the aforementioned range, in contrast, it is possible to impart the inner layer 2 and, hence, the roller body 5 with higher flexibility by improving the foamability of the semiconductive rubber composition and increasing the expansion ratio, while suppressing the increase in the roller resistance of the developing roller 1 and the displacement of the outer layer 4.

Where the oil-extension type EPDM containing the paraffin oil as the extension oil is used as the EPDM, as described above, the oil-extension type EPDM may contain the extension oil in a proportion falling within the aforementioned range based on 100 parts by mass of the EPDM. If the proportion of the extension oil is insufficient, the paraffin oil may be added to the semiconductive rubber composition. If the proportion of the extension oil is excessive, the non-oil-extension type EPDM or the like may be added to the semiconductive rubber composition.

<Carbon Black>

Usable as the carbon black are various carbon blacks each having a DBP oil absorption amount of not less than 400 $cm^3$/100 g and electron conductivity as described above. Examples of the carbon black include KETJEN BLACK (registered trade name) EC600JD (granular carbon black having a DBP oil absorption amount of 495 $cm^3$/100 g) and ECP600JD (powdery carbon black having a DBP oil absorption amount of 495 $cm^3$/100 g) available from Lion Specialty Chemicals Co., Ltd. The DBP oil absorption amount of the carbon black is particularly preferably not greater than 600 $cm^3$/100 g within the aforementioned range.

The proportion of the carbon black to be blended is preferably not less than 5 parts by mass and not greater than 20 parts by mass, particularly preferably not less than 10 parts by mass and not greater than 15 parts by mass, based on 100 parts by mass of the overall rubber component.

If the proportion of the carbon black is less than the aforementioned range, it will be impossible to sufficiently provide the effect of the blending of the carbon black for imparting the semiconductive rubber composition with the semiconductivity to reduce the roller resistance of the developing roller 1 to the range suitable for the developing roller 1. If the proportion of the carbon black is greater than the aforementioned range, on the other hand, the melt viscosity of the semiconductive rubber composition is liable to be increased to reduce the foamability of the semiconductive rubber composition, making it impossible to sufficiently provide the effect of the blending of the carbon black for increasing the expansion ratio to improve the flexibility of the inner layer 2 and, hence, the flexibility of the roller body 5.

Where the proportion of the carbon black falls within the aforementioned range, in contrast, it is possible to impart the semiconductive rubber composition with the semiconductivity to sufficiently reduce the roller resistance of the developing roller 1 to the range suitable for the developing roller 1, while imparting the inner layer 2 and, hence, the roller body 5 with higher flexibility by improving the foamability of the semiconductive rubber composition to increase the expansion ratio.

The semiconductive rubber composition for the inner layer 2 may be prepared by blending predetermined proportions of a foaming component for foaming the rubber composition to impart the inner layer 2 with the porous structure, a crosslinking component for crosslinking the rubber component, and the like with the aforementioned ingredients.

<Foaming Component>

A foaming agent which is thermally decomposable to generate gas and a foaming assisting agent which reduces the decomposition temperature of the foaming agent to accelerate the decomposition of the foaming agent are preferably used in combination as the foaming component.

(Foaming Agent)

Usable as the foaming agent are various compounds which are thermally decomposable to generate gas. Examples of the foaming agent include 4,4'-oxybis(benzenesulfonylhydrazide) (OBSH), azodicarbonamide (ADCA) and N,N-dinitrosopentamethylene tetramine (DPT), which may be used alone or in combination. Particularly, OBSH is preferred. Since the gas generated by the decomposition of OBSH contains neither ammonia nor formalin, OBSH prevents the contamination of the photoreceptor body, which may otherwise occur due to ammonia and formalin. Further, OBSH can reduce the environmental load.

The proportion of the foaming agent such as OBSH is preferably not less than 1 part by mass and not greater than 15 parts by mass, particularly preferably not less than 6 parts by mass and not greater than 10 parts by mass, based on 100 parts by mass of the overall rubber component in order to properly foam the semiconductive rubber composition to increase the expansion ratio for improvement of the flexibility of the inner layer 2 and, hence, the flexibility of the roller body 5.

(Foaming Assisting Agent)

Usable as the foaming assisting agent are various compounds which function to reduce the decomposition temperature of the foaming agent to be used in combination with the foaming assisting agent for acceleration of the decomposition of the foaming agent. Where the foaming agent is OBSH or ADCA, for example, urea ($H_2NCONH_2$) foaming assisting agents are preferred.

The proportion of the foaming assisting agent to be blended is preferably not less than 1 part by mass and not greater than 5 parts by mass based on 100 parts by mass of the overall rubber component.

<Crosslinking Component>

The crosslinking component for crosslinking the rubber component includes a crosslinking agent and a crosslinking accelerating agent.

(Crosslinking Agent)

Examples of the crosslinking agent include a sulfur crosslinking agent, a thiourea crosslinking agent, a triazine derivative crosslinking agent, a peroxide crosslinking agent and monomers, which may be used alone or in combination. Particularly, the sulfur crosslinking agent is preferred.

Examples of the sulfur crosslinking agent include sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine. Particularly, the sulfur is preferred.

The proportion of the sulfur to be blended is preferably not less than 0.5 parts by mass and not greater than 2 parts by mass based on 100 parts by mass of the overall rubber component in order to produce the inner layer 2 having proper flexibility suitable for the developing roller and a smaller compression set with higher productivity by properly crosslinking the rubber component.

Where the oil-treated sulfur powder, the dispersive sulfur or the like is used as the sulfur, for example, the proportion of the sulfur described above is defined as the effective proportion of sulfur contained in the oil-treated sulfur powder or the dispersive sulfur.

Where the organic sulfur-containing compound is used as the crosslinking agent, the proportion of the organic sulfur-containing compound is preferably adjusted so that the proportion of sulfur contained in molecules of the organic sulfur-containing compound falls within the aforementioned range based on 100 parts by mass of the overall rubber component.

(Crosslinking Accelerating Agent)

Examples of a crosslinking accelerating agent to be used in combination with the sulfur cross linking agent include inorganic accelerating agents such as lime, magnesia (MgO) and litharge (PbO), and organic accelerating agents, which may be used alone or in combination. Examples of the organic accelerating agents include a thiazole accelerating agent, a thiuram accelerating agent, a sulfenamide accelerating agent and a dithiocarbamate accelerating agent, which may be used alone or in combination. Of these crosslinking accelerating agents, the thiazole accelerating agent and the thiuram accelerating agent are preferably used in combination.

Examples of the thiazole accelerating agent include 2-mercaptobenzothiazole, di-2-benzothiazolyl disulfide, a zinc salt of 2-mercaptobenzothiazole, a cyclohexylamine salt of 2-mercaptobenzothiazole, 2-(N,N-diethylthiocarbamoylthio)benzothiazole and 2-(4'-morpholinodithio)benzothiazole, which may be used alone or in combination. Particularly, di-2-benzothiazolyl disulfide is preferred.

Examples of the thiuram accelerating agent include tetramethylthiuram monosulfide, tetramethylthiuram disulfide, tetraethylthiuram disulfide, tetrabutylthiuram disulfide, tetrakis(2-ethylhexyl)thiuram disulfide and dipentamethylenethiuram tetrasulfide, which may be used alone or in combination. Particularly, tetramethylthiuram monosulfide is preferred.

In order to sufficiently provide the effect of the combinational use of the aforementioned two types of crosslinking accelerating agents for accelerating the crosslinking reaction, the proportion of the thiazole accelerating agent to be blended is preferably not less than 1 part by mass and not greater than 5 parts by mass based on 100 parts by mass of the overall rubber component, and the proportion of the thiuram accelerating agent to be blended is preferably not less than 0.5 parts by mass and not greater than 2 parts by mass based on 100 parts by mass of the overall rubber component.

<Other Ingredients>

As required, the semiconductive rubber composition may further contain various additives. Examples of the additives include a crosslinking acceleration assisting agent and a filler.

Examples of the crosslinking acceleration assisting agent include metal compounds such as zinc oxide (zinc white), fatty acids such as stearic acid, oleic acid and cotton seed fatty acids, and other conventionally known crosslinking acceleration assisting agents, which may be used alone or in combination. The proportions of these crosslinking acceleration assisting agents to be blended are preferably each not less than 0.1 part by mass and not greater than 7 parts by mass based on 100 parts by mass of the overall rubber component.

Examples of the filler include zinc oxide, silica, carbon black for reinforcement, clay, talc, calcium carbonate, magnesium carbonate and aluminum hydroxide, which may be used alone or in combination. The blending of the filler improves the mechanical strength and the like of the inner layer 2. The proportion of the filler to be blended is preferably not less than 20 parts by mass and not greater than 40 parts by mass based on 100 parts by mass of the overall rubber component.

Other examples of the additives include a plasticizing agent, a processing aid, a degradation preventing agent, an anti-scorching agent, a lubricant, a pigment, an anti-static agent, a flame retarder, a neutralizing agent, a nucleating agent and a co-crosslinking agent, which may be added in proper proportions to the semiconductive rubber composition.

<Inner Layer 2>

The inner layer 2 is formed from the semiconductive rubber composition containing the aforementioned ingredients in the following manner. First, the prepared semiconductive rubber composition is extruded into a tubular body by an extruder. Then, the tubular body is cut to a predetermined length, and the rubber component of the semiconductive rubber composition of the tubular body is crosslinked and foamed in a vulcanization can by pressure and heat. Subsequently, the crosslinked and foamed tubular body is secondarily crosslinked with heating in an oven or the like, and then cooled. Thereafter, the outer peripheral surface 3 of the resulting inner layer 2 is polished to a predetermined outer diameter. Various polishing methods such as a dry traverse polishing method may be employed for the polishing.

<Shaft 7>

The shaft 7 is a unitary member made of a metal such as iron, aluminum, an aluminum alloy or a stainless steel. The shaft 7 may be inserted through and fixed to the through-hole 6 at any time between the end of the cutting of the tubular body and the end of the polishing of the outer peripheral surface 3 of the inner layer 2.

However, it is preferred to carry out the secondary crosslinking and the polishing with the shaft 7 inserted through the through-hole 6 after the cutting. This suppresses the warpage and the deformation of the inner layer 2, which may otherwise occur due to the expansion and the contraction of the inner layer 2 during the secondary crosslinking. Further, the outer peripheral surface 3 may be polished while being rotated about the shaft 7. This improves the working efficiency in the polishing, and suppresses the deflection of the outer peripheral surface 3.

A shaft having an outer diameter that is greater than the inner diameter of the through-hole 6 may be used as the shaft 7, and press-inserted into the through-hole 6. Alternatively, the shaft 7 may be inserted through the through-hole 6 of the inner layer 2 with the intervention of an electrically conductive thermosetting adhesive agent between the shaft 7 and the inner layer 2 before the secondary crosslinking. In the former case, the shaft 7 is electrically connected to and mechanically fixed to the inner layer 2 simultaneously with the press insertion of the shaft 7. In the latter case, the thermosetting adhesive agent is cured when the tubular body is heated in the oven for the secondary crosslinking, whereby the shaft 7 is electrically connected to and mechanically fixed to the inner layer 2. These arrangements may be used in combination to achieve the electrical connection and the mechanical fixing between the shaft 7 and the inner layer 2.

<<Outer Layer 4>>

<Polyurethane Thermoplastic Elastomer>

Usable as the polyurethane thermoplastic elastomer are various polyurethane thermoplastic elastomers each having a urethane bond in a molecule thereof and, as described above, having a type-A durometer hardness of not higher than 93 as measured at a measurement temperature of 23° C.

Particularly, a polyether type polyurethane thermoplastic elastomer is preferred, which is classified according to the structure of the main chain. The polyether type polyurethane thermoplastic elastomer is less susceptible to hydrolysis than a polyester type polyurethane thermoplastic elastomer. Therefore, the developing roller 1 can be continuously used for a longer period of time without any problem, for example, even in a high-temperature high-humidity environment.

Examples of the polyether type polyurethane thermoplastic elastomer having a type-A durometer hardness falling within the aforementioned range include ELASTOLLAN (registered trade name) series ET870-11V (having a type-A durometer hardness of 71±3), 1180A (having a type-A durometer hardness of 80±2), ET880 (having a type-A durometer hardness of 80±2), ET385 (having a type-A durometer hardness of 85±2), ET885 (having a type-A durometer hardness of 85±2), ET890A50S (having a type-A durometer hardness of 90±2) and 1190ATR (having a type-A durometer hardness of 91±2) available from BASF Japan Ltd., which may be used alone or in combination.

For further improvement of the aforementioned effect, the type-A durometer hardness of the polyurethane thermoplastic elastomer is particularly preferably not higher than 75 within the aforementioned range. If the type-A durometer hardness of the polyurethane thermoplastic elastomer is lower than 60, however, it will be impossible to ensure the dimensional accuracy of the outer layer with a difficulty in forming the polyurethane thermoplastic elastomer into the outer layer shape. Therefore, the type-A durometer hardness of the polyurethane thermoplastic elastomer is particularly preferably not lower than 60 within the aforementioned range.

<Carbon Black>

Usable as the carbon black are various carbon blacks having electron conductivity. In order to impart the outer layer 4 with proper electron conductivity by the electrically conductive circuit formation mechanism described above, the carbon black preferably has a DBP oil absorption amount of not less than 150 $cm^3$/100 g. The lower limit of the DBP oil absorption amount of the carbon black usable for the outer layer 4 can be set lower than that for the inner layer 2. This is because the formation of the electrically conductive circuit is difficult for the inner layer 2 of the porous structure but is relatively easy for the outer layer 4 of the nonporous structure.

An example of the electron conductive carbon black having a DBP oil absorption amount falling within the aforementioned range is DENKA BLACK (having a DBP oil absorption amount of 160 $cm^3$/100 g) available from Denka Co., Ltd. The carbon black to be blended for the production of the inner layer 2 is also usable. The DBP oil absorption amount of the carbon black is particularly preferably not greater than 600 $cm^3$/100 g within the aforementioned range.

The proportion of the carbon black to be blended is preferably not less than 20 parts by mass and not greater than 60 parts by mass, particularly preferably not less than 30 parts by mass and not greater than 70 parts by mass, based on 100 parts by mass of the polyurethane thermoplastic elastomer.

If the proportion of the carbon black is less than the aforementioned range, it will be impossible to sufficiently provide the effect of the blending of the carbon black for imparting the tube with semiconductivity to reduce the roller resistance of the developing roller 1 to the range suitable for the developing roller 1. If the proportion of the carbon black is greater than the aforementioned range, on the other hand, the tube is liable to become harder, making it impossible to sufficiently provide the effect of the blending of the carbon black for improving the flexibility of the roller body 5.

Where the proportion of the carbon black falls within the aforementioned range, in contrast, it is possible to impart the tube with the semiconductivity to sufficiently reduce the roller resistance of the developing roller 1 to the range suitable for the developing roller 1, while improving the flexibility of the tube to impart the roller body 5 with higher flexibility.

<Crosslinked PMMA Particles>

Fine particles of a crosslinked product of polymethyl methacrylate are used as the crosslinked PMMA particles.

The crosslinked PMMA particles should have a median particle diameter of not less than 5 μm and not greater than 20 μm for the aforementioned reason.

Examples of the crosslinked PMMA particles having a median particle diameter falling within the aforementioned range include TECHPOLYMER (registered trade name) series MB30X-5 (having a median particle diameter of 5 μm), MB30X-12 (having a median particle diameter of 12 μm) and MB30X-20 (having a median particle diameter of 20 μm) available from Sekisui Plastics Co., Ltd., which may be used alone or in combination.

For further improvement of the aforementioned effect, the median particle diameter of the crosslinked PMMA particles is particularly preferably not less than 8 μm and not greater than 16 μm within the aforementioned range.

The proportion of the crosslinked PMMA particles is preferably not less than 1 part by mass and not greater than 20 parts by mass, particularly preferably not less than 2 parts by mass and not greater than 10 parts by mass, based on 100 parts by mass of the polyurethane thermoplastic elastomer.

If the proportion of the crosslinked PMMA particles is less than the aforementioned range, the outer peripheral surface 8 of the roller body 5 is liable to have insufficient surface roughness. Therefore, the amount of the toner to be carried on the outer peripheral surface 8 will be insufficient, resulting in the formation of lower-density images or blurred images.

If the proportion of the crosslinked PMMA particles is greater than the aforementioned range, on the other hand, the outer peripheral surface 8 of the roller body 5 is liable to have excessively great surface roughness. Therefore, an excessively great amount of toner will be carried on the outer peripheral surface 8, so that the individual toner particles have a reduced chance of being rubbed with each other. This will result in insufficient toner charge amount and, hence, in the fogging defect. Further, the tube is liable to become harder, failing to sufficiently improve the flexibility of the roller body 5.

Where the proportion of the crosslinked PMMA particles falls within the aforementioned range, in contrast, it is possible to adjust the surface roughness of the outer peripheral surface 8 of the roller body 5 within the range suitable for carrying the toner to ensure the proper image formation without any of the imaging defects, while improving the flexibility of the tube to impart the roller body 5 with higher flexibility.

<Tube, Outer Layer 4, Roller Body 5 and Developing Roller 1>

The developing roller 1 which includes the roller body 5 having the inner layer 2 described above and the outer layer 4 formed of the elastomer composition containing the aforementioned ingredients is produced in the following manner. First, the elastomer composition is extruded into a tubular shape having a predetermined wall thickness and a predetermined inner diameter. Thus, a seamless nonporous semiconductive tube is produced. The inner diameter of the tube is set so as to be generally equal to the outer diameter of the inner layer 2 or slightly smaller than the outer diameter of the inner layer 2.

Then, the inner layer 2 with the shaft 7 inserted through and fixed to the center through-hole 6 thereof is squeezed into the tube described above. Thus, the inner layer 2 and the tube are electrically connected to and mechanically fixed to each other, whereby the developing roller 1 is produced which includes the roller body 5 having a double layer structure including the inner layer 2 and the outer layer 4 of the tube.

Further, one or two or more intermediate layers may be optionally provided between the inner layer 2 and the outer layer 4. For simplification of the construction of the roller body 5, however, the roller body 5 preferably has the double layer structure including the inner layer 2 and the outer layer 4 directly provided on the inner layer 2 as shown in FIGS. 1A and 1B.

The inventive developing roller 1 is incorporated in an electrophotographic image forming apparatus such as a laser printer, an electrostatic copying machine, a plain paper facsimile machine or a printer-copier-facsimile multifunction machine.

EXAMPLES

The present invention will hereinafter be described in greater detail by way of Examples and Comparative Examples. It should be understood that the invention be not necessarily limited to these examples.

<Inner Layer (a)>

(Semiconductive Rubber Composition)

While 100 parts by mass of EPDM (non-oil-extension type, ESPRENE EPDM 505A available from Sumitomo Chemical Co., Ltd., and having an ethylene content of 50% and a diene content of 9.5% as described above) was simply kneaded by a Banbury mixer, the following ingredients were added to and kneaded with the EPDM.

TABLE 1

| Ingredients | Parts by mass |
|---|---|
| Paraffin oil | 70 |
| Carbon black | 12 |
| Foaming agent | 8 |
| Foaming assisting agent | 2 |
| Crosslinking acceleration assisting agent I | 5 |
| Crosslinking acceleration assisting agent II | 1 |
| Filler | 30 |

The ingredients shown in Table 1 are as follows. The amounts (parts by mass) of the respective ingredients shown in Table 1 are based on 100 parts by mass of the EPDM. Paraffin oil: DIANA PROCESS OIL PW380 available from Idemitsu Kosan Co., Ltd., as described above, and having a dynamic viscosity of 30.86 $mm^2/s$ at 100° C. and an aniline point of 144° C. Carbon black: KETJEN BLACK EC600JD available from Lion Specialty Chemicals Co., Ltd., and having a DBP oil absorption amount of 495 $cm^3/100$ g as described above Foaming agent: OBSH, NEOCELLBON N#1000S available from Eiwa Chemical Industry Co., Ltd., and having a median diameter of 14 μm Foaming assisting agent: Urea foaming assisting agent, CELLPASTE 101 available from Eiwa Chemical Industry Co., Ltd.

Crosslinking acceleration assisting agent I: Zinc oxide available from Mitsui Mining & Smelting Co., Ltd.

Crosslinking acceleration assisting agent II: Stearic acid available from NOF Corporation Filler: Heavy calcium carbonate, BF-300 available from Shiraishi Calcium K.K., and having an average particle diameter of 8.0 μm Subsequently, the resulting mixture was continuously kneaded, and the following crosslinking component was added to and further kneaded with the mixture. Thus, a semiconductive rubber composition was prepared.

TABLE 2

| Ingredients | Parts by mass |
|---|---|
| Crosslinking agent | 1.6 |
| Crosslinking accelerating agent TS | 1.0 |
| Crosslinking accelerating agent DM | 2.0 |

The ingredients shown in Table 2 are as follows. The amounts (parts by mass) of the respective ingredients shown in Table 2 are based on 100 parts by mass of the EPDM.

Crosslinking agent: 5% oil-containing fine sulfur powder, KINKA MARK available from Tsurumi Chemical Industry Co., Ltd.

Crosslinking accelerating agent TS: Thiuram accelerating agent, tetramethylthiuram monosulfide, SANCELER (registered trade name) TS available from Sanshin Chemical Industry Co., Ltd.

Crosslinking accelerating agent DM: Thiazole accelerating agent, di-2-benzothiazyl disulfide, SUNSINE METS available from Shandong Shanxian Chemical Co., Ltd.

(Inner Layer)

The semiconductive rubber composition thus prepared was fed into an extruder, and extruded into a tubular body having an outer diameter of 15 mm and an inner diameter of 6.5 mm. Then, the tubular body was fitted around a temporary crosslinking shaft, and crosslinked and foamed at 160° C. for 1 hour.

Subsequently, the crosslinked tubular body was removed from the temporary shaft, then fitted around a shaft having an outer diameter of 7.0 mm and an outer peripheral surface to which an electrically conductive thermosetting adhesive agent was applied, and heated in an oven at 160° C. Thus, the tubular body was bonded to the shaft. Thereafter, the outer peripheral surface of the resulting tubular body was finished to an outer diameter $D_1$ of $D_1$=15.5 mm by polishing with the use of a cylindrical polishing machine. Thus, an inner layer (a) unified with the shaft was produced.

<Inner Layer (b)>

A semiconductive rubber composition was prepared and an inner layer (b) unified with a shaft was produced in substantially the same manner as the inner layer (a), except that 100 parts by mass of carbon black (DENKA BLACK particles available from Denka Co., Ltd., and having a DBP oil absorption amount of 160 $cm^3/100$ g as described above) was blended and the proportion of the paraffin oil was 100 parts by mass.

<Tube (A)>

(Elastomer Composition)

An elastomer composition was prepared by kneading 100 parts by mass of a polyurethane thermoplastic elastomer (polyether type, ELASTOLLAN ET870-11V available from BASF Japan Ltd., and having a type-A durometer hardness of 71±3 as described above), 40 parts by mass of carbon black (DENKA BLACK particles available from Denka Co., Ltd., and having a DBP oil absorption amount of 160 $cm^3/100$ g as described above) and 3 parts by mass of crosslinked PMMA particles (TECHPOLYMER MB30X-5 available from Sekisui Plastics Co., Ltd., and having a median particle diameter of 5 μm as described above) by means of a twin screw extruder.

(Tube)

The elastomer composition thus prepared was fed into an extruder, and extruded into a tubular shape having an outer diameter of 16 mm and an inner diameter of 15.6 mm. Thus, a tube (A) for the outer layer was produced.

<Tube (B)>

An elastomer composition was prepared and a tube (B) was produced in substantially the same manner as the tube (A), except that crosslinked PMMA particles (TECHPOLYMER MB30X-12 available from Sekisui Plastics Co., Ltd., and having a median particle diameter of 12 μm as described above) were blended in the same proportion.

<Tube (C)>

An elastomer composition was prepared and a tube (C) was produced in substantially the same manner as the tube (A), except that crosslinked PMMA particles (TECHPOLYMER MB30X-20 available from Sekisui Plastics Co., Ltd., and having a median particle diameter of 20 μm as described above) were blended in the same proportion.

<Tube (D)>

An elastomer composition was prepared and a tube (D) was produced in substantially the same manner as the tube (B), except that a polyurethane thermoplastic elastomer (polyether type, ELASTOLLAN ET890A50S available from BASF Japan Ltd., and having a type-A durometer hardness of 90±2 as described above) was blended in the same proportion.

<Tube (E)>

An elastomer composition was prepared and a tube (E) was produced in substantially the same manner as the tube (B), except that 50 parts by mass of carbon black (SEAST 6 available from Tokai Carbon Co., Ltd., and having a DBP oil absorption amount of 114 $cm^3/100$ g) was blended.

<Tube (F)>

An elastomer composition was prepared and a tube (F) was produced in substantially the same manner as the tube (B), except that a polyurethane thermoplastic elastomer (polyether type, ELASTOLLAN ET890A50S available from BASF Japan Ltd., and having a type-A durometer hardness of 90±2 as described above) was blended in the same proportion and 50 parts by mass of carbon black (SEAST 6 available from Tokai Carbon Co., Ltd., and having a DBP oil absorption amount of 114 $cm^3/100$ g) was blended.

<Tube (G)>

An elastomer composition was prepared and a tube (G) was produced in substantially the same manner as the tube (A), except that crosslinked PMMA particles (TECHPOLYMER MB30X-30 available from Sekisui Plastics Co., Ltd., and having a median particle diameter of 30 μm) were blended in the same proportion.

<Tube (H)>

An elastomer composition was prepared and a tube (H) was produced in substantially the same manner as the tube (A), except that crosslinked PMMA particles (TECHPOLYMER SSX-101 available from Sekisui Plastics Co., Ltd., and having a median particle diameter of 1 μm) were blended in the same proportion.

<Tube (I)>

An elastomer composition was prepared and a tube (I) was produced in substantially the same manner as the tube (B), except that a polyurethane thermoplastic elastomer (polyether type, ELASTOLLAN ET856D50 available from BASF Japan Ltd., and having a type-D durometer hardness of 56±3) was blended in the same proportion.

<Tube (J)>

An elastomer composition was prepared and a tube (J) was produced in substantially the same manner as the tube (A), except that the crosslinked PMMA particles were not blended.

<Tube (K)>

An elastomer composition was prepared and a tube (K) was produced in substantially the same manner as the tube (B), except that a polyamide thermoplastic elastomer (UBESTA (registered trade name) 3030U available from Ube Industries, Ltd., and having a type-D durometer hardness of 78) was blended instead of the polyurethane thermoplastic elastomer in the same proportion and the proportion of the carbon black was 45 parts by mass.

Examples 1 to 6 and Comparative Examples 1 to 6

For production of developing rollers, the inner layers (a) and (b) were selectively combined with the tubes (A) to (K) as shown below in Tables 3 and 4. More specifically, the developing rollers were each produced by squeezing the inner layer (a) or (b) into a corresponding one of the tubes (A) to (K) and cutting opposite ends of the tube to produce a roller body.

<Asker-C hardness of Roller Body>

The Asker-C hardness of each of the roller bodies of the developing rollers produced in Examples and Comparative Examples was measured at 23° C. by a measuring method specified in Society of Rubber Industry, Japan, Standard SRIS 0101 "Physical Testing Method for Expanded Rubber."

<Actual Machine Test>

The developing rollers produced in Examples and Comparative Examples were each mounted in place of an original developing roller of a new toner cartridge TN-62J for a laser printer (HL-L6400DW available from Brother Industries, Ltd.), and then the toner cartridge was mounted in the laser printer. An image was formed sequentially on 8000 paper sheets at an image density of 5% in an environment at a temperature of 23±1° C. at a relative humidity of 55±1%. The developing rollers were each evaluated for formed image quality based on the following criteria:

◎ (Very good): The formed images were free from coarseness, fogging, density reduction, blurriness, density unevenness and other imaging defects, and each had a very good image quality.

○ (Good): The formed images each had a good image quality with the density reduction and the fogging slightly observed.

Δ (Acceptable): The formed images each had a practically acceptable image quality with the density reduction and the fogging more distinctly observed than those for the developing roller rated as good (○).

× (Unacceptable): The formed images each had a bad image quality with at least one of the imaging defects distinctly observed.

Further, the toner cartridge was visually inspected for toner leakage after the sequential image formation.

The above results are shown in Tables 3 and 4. Abbreviations for the types of the thermoplastic elastomer in Tables 3 and 4 are: PU for the polyurethane thermoplastic elastomers; and PA for the polyamide thermoplastic elastomer. Numerals for the hardness of the thermoplastic elastomer each indicate a median hardness, and are each suffixed with "A" for type-A durometer hardness or with "D" for type-D durometer hardness for distinction.

TABLE 3

| | Example 1 | Example 2 | Example 3 | Example 4 | Example 5 | Example 6 |
|---|---|---|---|---|---|---|
| Inner layer | | | | | | |
| Type | a | a | a | a | a | a |
| Carbon black | | | | | | |
| DBP oil absorption amount ($cm^3$/100 g) | 495 | 495 | 495 | 495 | 495 | 495 |
| Parts by mass | 12 | 12 | 12 | 12 | 12 | 12 |
| Outer layer | | | | | | |
| Type | A | B | C | D | E | F |
| Thermoplastic elastomer | | | | | | |
| Type | PU | PU | PU | PU | PU | PU |
| Hardness | 71A | 71A | 71A | 90A | 71A | 90A |
| DBP oil absorption amount ($cm^3$/100 g) of carbon black | 160 | 160 | 160 | 160 | 114 | 114 |
| Median particle diameter (μm) of crosslinked PMMA particles | 5 | 12 | 20 | 12 | 12 | 12 |

TABLE 3-continued

| | Example 1 | Example 2 | Example 3 | Example 4 | Example 5 | Example 6 |
|---|---|---|---|---|---|---|
| Evaluation | | | | | | |
| Asker-C hardness | 40 | 40 | 40 | 56 | 44 | 60 |
| Image quality of formed images | ○ | ◎ | ○ | ○ | Δ | Δ |
| Toner leakage | No | No | No | No | No | No |

TABLE 4

| | Comparative Example 1 | Comparative Example 2 | Comparative Example 3 | Comparative Example 4 | Comparative Example 5 | Comparative Example 6 |
|---|---|---|---|---|---|---|
| Inner layer | | | | | | |
| Type | a | b | a | a | a | a |
| Carbon black | | | | | | |
| DBP oil absorption amount ($cm^3$/100 g) | 495 | 160 | 495 | 495 | 495 | 495 |
| Parts by mass | 12 | 100 | 12 | 12 | 12 | 12 |
| Outer layer | | | | | | |
| Type | I | B | J | K | G | H |
| Thermoplastic elastomer | | | | | | |
| Type | PU | PU | PU | PA | PU | PU |
| Hardness | 56D | 71A | 71A | 78D | 71A | 71A |
| DBP oil absorption amount ($cm^3$/100 g) of carbon black | 160 | 160 | 160 | 160 | 160 | 160 |
| Median particle diameter (μm) of crosslinked PMMA particles | 12 | 12 | — | 12 | 30 | 1 |
| Evaluation | | | | | | |
| Asker-C hardness | 85 | 83 | 39 | 100< | 40 | 40 |
| Image quality of formed images | X | X | X | X | X | X |
| Toner leakage | No | No | No | YES | No | No |

The developing roller of Comparative Example 1 in which the outer layer was formed of the hard polyurethane thermoplastic elastomer having a type-A durometer hardness of greater than 93 suffered from an imaging defect (formation of coarse images) due to deterioration of the toner during the repeated image formation with reduced flexibility of the roller body. The developing roller of Comparative Example 2 in which the inner layer contained a great amount of the carbon black having a DBP oil absorption amount of less than 400 $cm^3$/100 g to impart the inner layer with semiconductivity also suffered from the imaging defect (formation of coarse images) due to deterioration of the toner during the repeated image formation with reduced flexibility of the roller body.

The developing roller of Comparative Example 3 in which the crosslinked PMMA particles were not contained in the surface layer suffered from an imaging defect (formation of lower-density images and blurred images) with an insufficient amount of toner carried on the outer peripheral surface of the roller body due to insufficient surface roughness of the outer peripheral surface. The developing roller of Comparative Example 4 in which the outer layer was formed of the polyamide thermoplastic elastomer suffered from the imaging defect (formation of coarse images) due to deterioration of the toner during the repeated image formation with reduced flexibility of the roller body, and also suffered from formation of uneven-density images. In addition, the developing roller of Comparative Example 4 had an insufficient wear resistance, and was worn during the repeated image formation, resulting in toner leakage.

The developing roller of Comparative Example 5 in which the crosslinked PMMA particles having a median particle diameter of greater than 20 μm were contained in the outer layer suffered from an imaging defect (formation of fogged images) due to an insufficient toner charge amount, which was caused because an excessively great amount of toner was carried on the outer peripheral surface of the roller body due to excessively great surface roughness of the outer peripheral surface of the roller body to thereby reduce the chance of rubbing the individual toner particles with each other. Further, the developing roller of Comparative Example 6 in which the crosslinked PMMA particles having a median particle diameter of less than 5 μm were contained in the outer layer suffered from formation of lower-density images and, hence, blurred images due to an insufficient amount of toner carried on the outer peripheral surface of the roller body with excessively small surface roughness of the outer peripheral surface of the roller body.

In contrast, the developing rollers of Examples 1 to 6 were free from the aforementioned imaging defects. Further, the developing rollers of Examples 1 to 6 were excellent in wear resistance and, therefore, free from toner leakage even after the repeated image formation.

These results indicate that the inner layer of the porous structure formed from the semiconductive rubber composition containing the ethylene propylene rubber, the paraffin oil and the carbon black having a DBP oil absorption amount of not less than 400 $cm^3$/100 g is preferably combined with the outer layer of the tube of the nonporous structure containing the polyurethane thermoplastic elastomer having a type-A durometer hardness of not greater than 93, the carbon black and the crosslinked PMMA particles having a median particle diameter of not less than 5 μm and not greater than 20 μm. Further, it is found that: EPDM is preferred as the ethylene propylene rubber; OBSH is preferred as the foaming agent for the inner layer; and the polyether type polyurethane thermoplastic elastomer is preferred as the polyurethane thermoplastic elastomer.

The results for Examples 1 to 6 indicate that, for further improvement of the effect for formation of higher-quality images free from these imaging defects, the type-A durometer hardness of the polyurethane thermoplastic elastomer for the outer layer is preferably not greater than 75, the carbon black contained in the outer layer preferably has a DBP oil absorption amount of not less than 150 $cm^3$/100 g, and the crosslinked PMMA particles preferably have a median particle diameter of not less than 8 μm and not greater than 16 μm.

This application corresponds to Japanese Patent Application No. 2017-128967 filed in the Japan Patent Office on Jun. 30, 2017, the disclosure of which is incorporated herein by reference in its entirety.

What is claimed is:

1. A developing roller comprising a roller body having a tubular inner layer and an outer layer, wherein the inner layer is formed from a semiconductive rubber composition comprising ethylene propylene rubber, paraffin oil, and carbon black having a DBP oil absorption amount of not less than 400 cm3/100 g, and has a porous structure, wherein the outer layer is a seamless nonporous semiconductive tube provided on an outer periphery of the inner layer, the seamless nonporous semiconductive tube comprising a polyurethane thermoplastic elastomer, carbon black, and particles of crosslinked polymethyl methacrylate having a median particle diameter of not less than 5 μm and not greater than 20 μm, wherein the polyurethane thermoplastic elastomer is a polyether type polyurethane thermoplastic elastomer, and wherein the type-A durometer hardness of the polyurethane thermoplastic elastomer is not less than 60 and not higher than 75 as measured at a measurement temperature of 23° C. in conformity with Japanese Industrial Standards JIS K7311-1995.

2. The developing roller according to claim 1, wherein the ethylene propylene rubber is ethylene propylene diene rubber.

3. The developing roller according to claim 1, wherein the porous structure of the inner layer is a porous structure produced by thermal decomposition of 4,4'-oxybis(benzenesulfonylhydrazide) functioning as a foaming agent.

4. The developing roller according to claim 1, wherein the carbon black for the outer layer has a DBP oil absorption amount of not less than 150 $cm^3$/100 g.

5. The developing roller according to claim 3, wherein the forming agent is not less than 1 part by mass and not greater than 15 parts by mass based on 100 parts by mass of the overall rubber composition.

* * * * *